US012662741B2

(12) United States Patent
Carper

(10) Patent No.: US 12,662,741 B2
(45) Date of Patent: Jun. 23, 2026

(54) HYDROGEN GENERATOR

(71) Applicant: The Boeing Company, Arlington, VA (US)

(72) Inventor: Judd S. Carper, Arlington, VA (US)

(73) Assignee: THE BOEING COMPANY, Arlington, VA (US)

( * ) Notice: Subject to any disclaimer, the term of this patent is extended or adjusted under 35 U.S.C. 154(b) by 633 days.

(21) Appl. No.: 18/176,847

(22) Filed: Mar. 1, 2023

(65) Prior Publication Data

US 2024/0295032 A1 Sep. 5, 2024

(51) Int. Cl.
*C25B 1/04* (2021.01)
*C25B 9/17* (2021.01)
*C25B 15/08* (2006.01)

(52) U.S. Cl.
CPC ..... *C25B 1/04* (2013.01); *C25B 9/17* (2021.01); *C25B 15/083* (2021.01)

(58) Field of Classification Search
CPC ..... C25B 1/04; C25B 9/17; C25B 15/083
See application file for complete search history.

(56) References Cited

PUBLICATIONS

Seo, Original & Machine Translation, KR 10-1735766 B1 (Year: 2017).*

* cited by examiner

*Primary Examiner* — Hosung Chung
(74) *Attorney, Agent, or Firm* — Moore IP Law

(57) ABSTRACT

A hydrogen generator includes a base including a first material that includes a semiconductor, glass, or ceramic, a cathode extending from the base, where the cathode includes the first material and is configured to facilitate generation of hydrogen in the presence of an electrolytic solution that includes water, an anode extending from the base, where the anode includes the first material and is configured to facilitate generation of oxygen in the presence of the electrolytic solution, where the base, the cathode, and the anode define a cavity, and a lid including a second material that includes a semiconductor, glass, or ceramic, the lid forming a first outlet between the cathode and the lid and a second outlet between the anode and the lid, where the hydrogen is configured to exit the cavity via the first outlet and the oxygen is configured to exit the cavity via the second outlet.

20 Claims, 10 Drawing Sheets

200

HYDROGEN GENERATOR

FIELD

The present disclosure generally relates to a hydrogen generator, and more specifically to a hydrogen generator formed of a material that includes a semiconductor, a glass, or a ceramic.

BACKGROUND

Many conventional hydrogen generators are not scalable, cannot suitably accommodate varying demands for hydrogen, and include moving parts that require regular maintenance. Additionally, many conventional implementations require storage and subsequent transport of the hydrogen to the points of consumption. Accordingly, a need exists for a hydrogen generator that is more scalable, better accommodates varying hydrogen demands, includes few or no moving parts, and can provide hydrogen near points of consumption.

SUMMARY

One aspect of the disclosure is a hydrogen generator comprising: a base comprising a first material that comprises a semiconductor, a glass, or a ceramic; a cathode extending from the base, wherein the cathode comprises the first material and is configured to facilitate generation of hydrogen in the presence of an electrolytic solution that comprises water; an anode extending from the base, wherein the anode comprises the first material and is configured to facilitate generation of oxygen in the presence of the electrolytic solution, wherein the base, the cathode, and the anode define a cavity; and a lid comprising a second material that comprises a semiconductor, a glass, or a ceramic, the lid forming a first outlet between the cathode and the lid and a second outlet between the anode and the lid, wherein the hydrogen is configured to exit the cavity via the first outlet and the oxygen is configured to exit the cavity via the second outlet.

Another aspect of the disclosure is a method of manufacturing a hydrogen generator, the method comprising: etching a material that comprises a semiconductor, a glass, or a ceramic to form: a base; a cathode extending from the base; and an anode extending from the base; forming a lid; and bonding the lid to the anode and the cathode to form a first outlet between the cathode and the lid and a second outlet between the anode and the lid.

Another aspect of the disclosure is a method of operating a hydrogen generator, the method comprising: flowing an electrolytic solution comprising water through a cavity, wherein the cavity is defined by a base, a cathode, and an anode of the hydrogen generator, and wherein the base, the cathode, and the anode each comprise a material that comprises a semiconductor, a glass, or a ceramic; and applying an electric field between the anode and the cathode while the anode and the cathode are immersed in the electrolytic solution, thereby: generating hydrogen at the cathode such that the hydrogen exits the cavity via a first outlet formed between the cathode and a lid of the hydrogen generator; and generating oxygen at the anode such that the oxygen exits the cavity via a second outlet formed between the anode and the lid.

By the term "about" or "substantially" with reference to amounts or measurement values described herein, it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

The features, functions, and advantages that have been discussed can be achieved independently in various examples or may be combined in yet other examples further details of which can be seen with reference to the following description and drawings.

BRIEF DESCRIPTION OF THE DRAWINGS

The novel features believed characteristic of the illustrative examples are set forth in the appended claims. The illustrative examples, however, as well as a preferred mode of use, further objectives and descriptions thereof, will best be understood by reference to the following detailed description of an illustrative example of the present disclosure when read in conjunction with the accompanying Figures.

DETAILED DESCRIPTION

As noted above, a need exists for a hydrogen generator that is more scalable, better accommodates varying hydrogen demands, includes few or no moving parts, and can provide hydrogen near points of consumption. Accordingly, this disclosure includes a hydrogen generator that includes a base including a first material that includes a semiconductor, a glass, and/or a ceramic. The hydrogen generator further includes a cathode extending from the base. The cathode includes the first material and is configured to facilitate generation of hydrogen in the presence of an electrolytic solution that comprises water. The hydrogen generator further includes an anode extending from the base. The anode includes the first material and is configured to facilitate generation of oxygen in the presence of the electrolytic solution. The base, the cathode, and the anode define a cavity. The hydrogen generator further includes a lid that includes a second material that includes a semiconductor, a glass, or a ceramic. The second material can be the same as the first material or can be different so long as the second material includes a semiconductor, a glass, and/or a ceramic. The lid forms a first outlet between the cathode and the lid and a second outlet between the anode and the lid. The hydrogen is configured to exit the cavity via the first outlet and the oxygen is configured to exit the cavity via the second outlet.

The hydrogen generator can facilitate hydrogen generation that is responsive to varying demand in challenging environments. The cellular nature of the design, the lack of moving parts, and the robustness of the materials used for construction can facilitate the creation of scalable and robust hydrogen production without the need for storage. The size and independent operation of each hydrogen generator facilitates control strategies (e.g., multiplexing), which can yield good control of the collective hydrogen output of the hydrogen generators.

Micro-machining and/or semiconductor planar technologies are often used to fabricate the hydrogen generator. The precision of such micro-machining processes can facilitate angstrom level control of the device features and be highly repeatable and scalable for mass production. In some examples, hydrogen produced by the hydrogen generator can be directly provided to a combustion chamber of an engine for efficient energy conversion.

Disclosed examples will now be described more fully hereinafter with reference to the accompanying Drawings, in which some, but not all of the disclosed examples are shown. Indeed, several different examples may be described and should not be construed as limited to the examples set forth herein. Rather, these examples are described so that this disclosure will be thorough and complete and will fully convey the scope of the disclosure to those skilled in the art.

Figure 1:
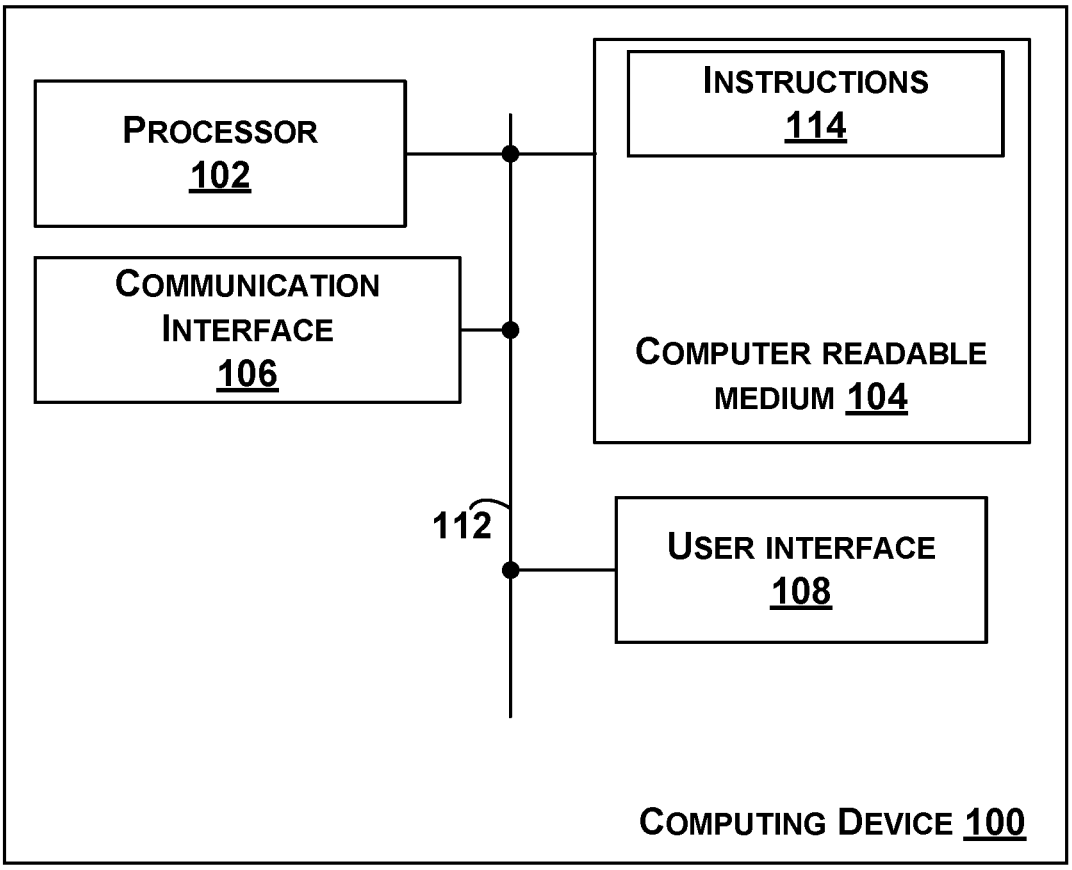
FIG. 1 is a block diagram of a computing device, according to an example.

FIG. 1 is a block diagram of a computing device 100. The computing device 100 includes one or more processors 102, a non-transitory computer readable medium 104, a communication interface 106, and a user interface 108. Components of the computing device 100 are linked together by a system bus, network, or other connection mechanism 112.

The one or more processors 102 can be any type of processor(s), such as a microprocessor, a field programmable gate array, a digital signal processor, a multicore processor, etc., coupled to the non-transitory computer readable medium 104.

The non-transitory computer readable medium 104 can be any type of memory, such as volatile memory like random access memory (RAM), dynamic random access memory (DRAM), static random access memory (SRAM), or non-volatile memory like read-only memory (ROM), flash memory, magnetic or optical disks, or compact-disc read-only memory (CD-ROM), among other devices used to store data or programs on a temporary or permanent basis.

Additionally, the non-transitory computer readable medium 104 can store instructions 114. The instructions 114 are executable by the one or more processors 102 to cause the computing device 100 to perform any of the functions or methods described herein.

The communication interface 106 can include hardware to enable communication within the computing device 100 and/or between the computing device 100 and one or more other devices. The hardware can include any type of input and/or output interfaces, a universal serial bus (USB), PCI Express, transmitters, receivers, and antennas, for example. The communication interface 106 can be configured to facilitate communication with one or more other devices, in accordance with one or more wired or wireless communication protocols. For example, the communication interface 106 can be configured to facilitate wireless data communication for the computing device 100 according to one or more wireless communication standards, such as one or more Institute of Electrical and Electronics Engineers (IEEE) 801.11 standards, ZigBee standards, Bluetooth standards, etc. As another example, the communication interface 106 can be configured to facilitate wired data communication with one or more other devices. The communication interface 106 can also include analog-to-digital converters (ADCs) or digital-to-analog converters (DACs) that the computing device 100 can use to control various components of the computing device 100 or external devices.

The user interface 108 can include any type of display component configured to display data. As one example, the user interface 108 can include a touchscreen display. As another example, the user interface 108 can include a flat-panel display, such as a liquid-crystal display (LCD) or a light-emitting diode (LED) display. The user interface 108 can include one or more pieces of hardware used to provide data and control signals to the computing device 100. For instance, the user interface 108 can include a mouse or a pointing device, a keyboard or a keypad, a microphone, a touchpad, or a touchscreen, among other possible types of user input devices. Generally, the user interface 108 can enable an operator to interact with a graphical user interface (GUI) provided by the computing device 100 (e.g., displayed by the user interface 108).

Figure 2:
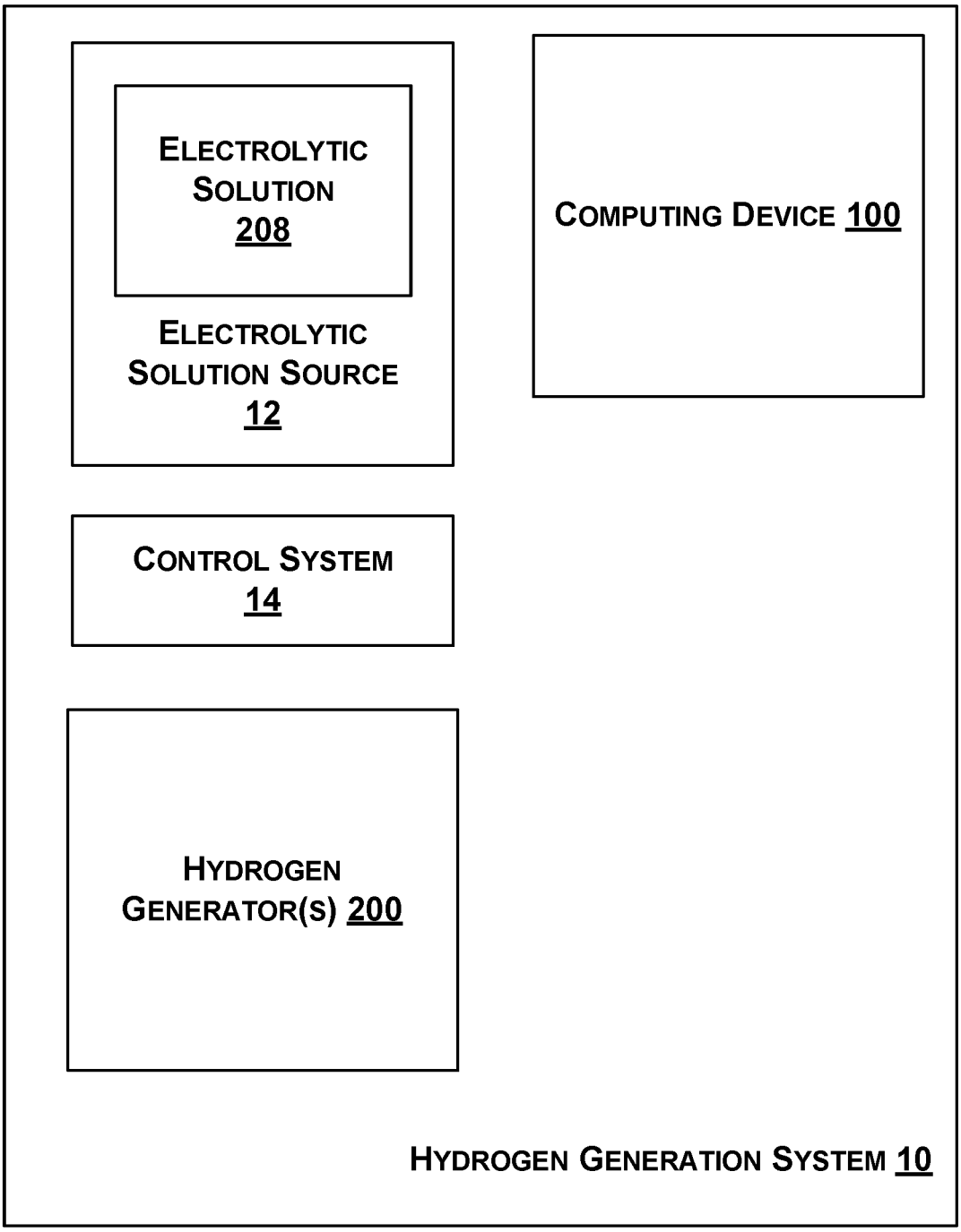
FIG. 2 is a block diagram of a hydrogen generation system, according to an example.

FIG. 2 is a block diagram of a hydrogen generation system 10. The hydrogen generation system 10 includes an electrolytic solution source 12, a control system 14, the computing device 100, and one or more hydrogen generators 200.

The electrolytic solution source 12 includes one or more pumps, tanks, and/or reservoirs capable of storing and/or mixing an electrolytic solution 208 and providing the electrolytic solution 208 to the one or more hydrogen generators 200.

The control system 14 is configured to receive commands from the computing device 100 and selectively provide the electrolytic solution 208 to the one or more hydrogen generators 200 as instructed by the computing device 100. The control system 14 also includes individually addressable contact leads that enable activation of electric fields within selected hydrogen generators 200 as instructed by the computing device 100.

The one or more hydrogen generators 200 are discussed in more detail below.

Figure 3:
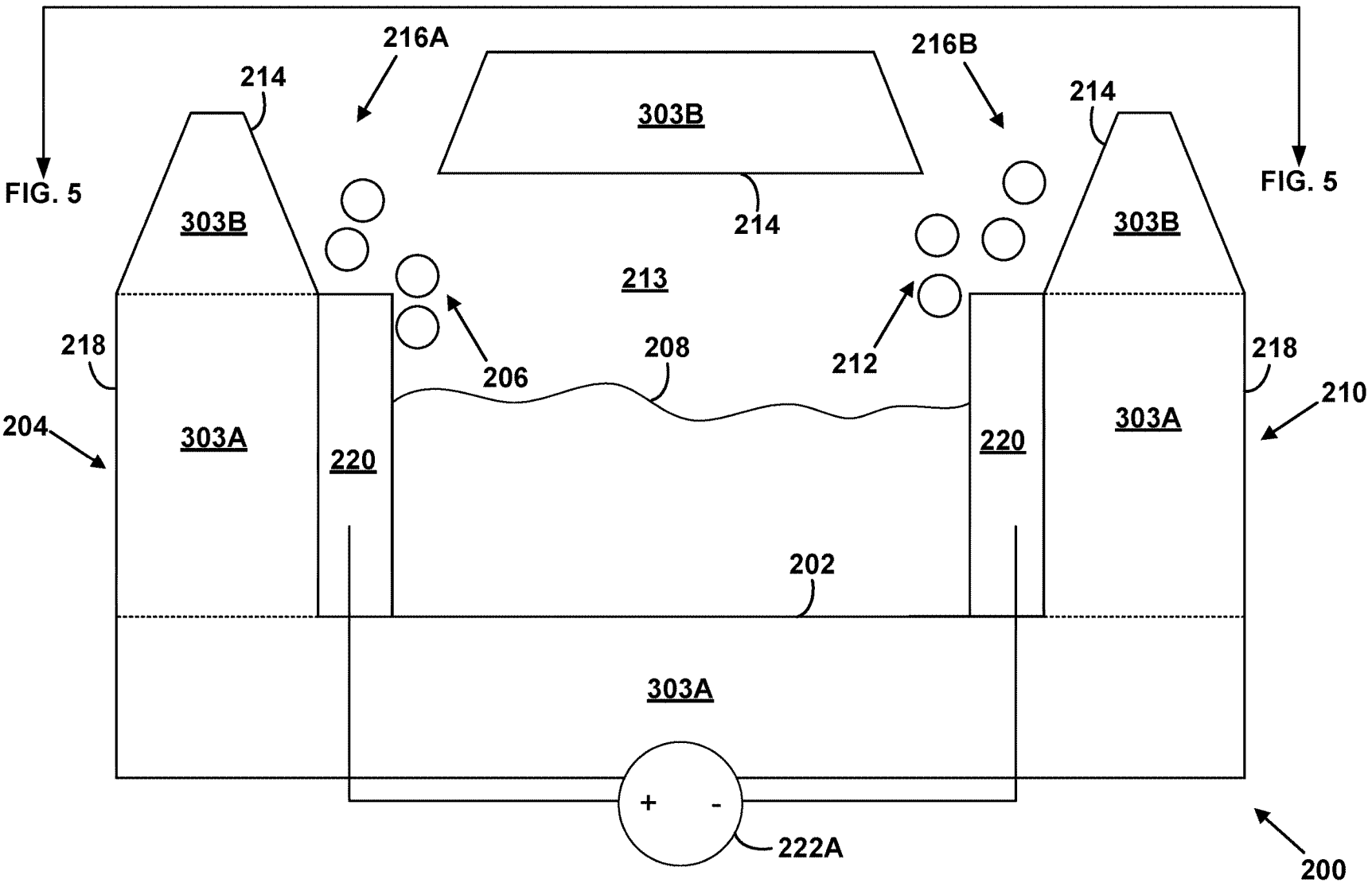
FIG. 3 is a schematic diagram of a hydrogen generator, according to an example.

FIG. 3 is a schematic diagram of a hydrogen generator 200. The hydrogen generator 200 includes a base 202 that comprises a material 303A that comprises a semiconductor, a glass, and/or a ceramic. The hydrogen generator 200 further includes a cathode 204 extending from the base 202. The cathode 204 comprises the material 303A and is configured to facilitate generation of hydrogen 206 in the presence of an electrolytic solution 208 that comprises water. The hydrogen generator 200 further includes an anode 210 extending from the base 202. The anode 210 also comprises the material 303A and is configured to facilitate generation of oxygen 212 in the presence of the electrolytic solution 208. The base 202, the cathode 204, and the anode 210 define a cavity 213. The hydrogen generator 200 further includes a lid 214 comprising a material 303B that comprises a semiconductor, a glass, and/or a ceramic. The lid 214 forms a first outlet 216A between the cathode 204 and the lid 214 and a second outlet 216B between the anode 210 and the lid 214. The hydrogen 206 is configured to exit the cavity 213 via the first outlet 216A and the oxygen 212 is configured to exit the cavity 213 via the second outlet 216B.

The base 202, the cathode 204, and the anode 210 generally form a singular structure. However, dashed lines are shown as example delineations within the material 303A between the base 202 and the cathode 204 and within the material 303A between the base 202 and the anode 210. Thus, the cathode 204 and the anode 210 are generally in contact with the base 202.

The base 202 typically includes a hydrophilic material (e.g., a coating) on an upward facing surface of the base 202 between the cathode 204 and the anode 210.

The material 303A of the base 202, the cathode 204, and the anode 210 is typically monocrystalline or polycrystalline. However, the material 303A can include monocrystalline silicon, polycrystalline silicon, amorphous silicon, 7740 Pyrex® borosilicate glass, and/or any other semiconductor, glass, and/or ceramic material suitable for etching via photolithography or other micro-machining processes such as laser ablation, molding, or computer numerical control (CNC) machining.

The material 303B of the lid 214 can be the same as the material 303A or different from the material 303A. The material 303B is typically monocrystalline or polycrystalline. However, the material 303B can include monocrystalline silicon, polycrystalline silicon, amorphous silicon, 740 Pyrex® borosilicate glass, and/or any other semiconductor, glass, and/or ceramic material suitable for etching via photolithography or other micro-machining processes such as laser ablation, molding, or computer numerical control (CNC) machining.

In FIG. 3, the cathode 204 and the anode 210 each include a portion 218 comprising the material 303A and a portion 220 that is supported by the portion 218. The portion 220 includes a conductive material such as a metal or a doped semiconductor. Metals can be deposited on the base 202 and alongside the portions 218 as shown via photolithography and/or metal evaporation. An adhesion layer such as chrome can be formed on the base 202 and/or alongside the portion 218 prior to the metal or conductive material (e.g., gold, platinum, aluminum, copper, a perovskite material, or lanthanum ferrite) being deposited on the adhesion layer.

Typically, the portion 220 of the cathode 204 can include materials such as platinum, gold, copper, or zinc.

Typically, the portion 220 of the anode 210 can include materials such as platinum, gold, copper, or zinc.

In some examples, the hydrogen generator 200 includes a power supply 222A configured to generate a first electric field within the cavity 213 between the anode 210 and the cathode 204. As shown, the power supply 222A is configured to generate field lines that originate from the portion 220 of the cathode 204 and terminate at the portion 220 of the anode 210. The first electric field enables the electrolysis process that generates the hydrogen 206 at the cathode 204 and the oxygen 212 at the anode 210.

The hydrogen generator 200 is typically formed by etching the material 303A to form the base 202, the cathode 204 extending from the base 202, and the anode 210 extending from the base 202 as a singular structure. For example, the etching can involve photolithography and/or isotropic and/or non-isotropic etching techniques, or other micro-machining processes such as laser ablation molding, or computer numerical control (CNC) machining.

Additionally, photolithography and/or isotropic and/or non-isotropic etching techniques, or other micro-machining processes such as laser ablation molding, or computer numerical control (CNC) machining can be used to form the lid 214. The lid 214 is typically formed separately from the singular structure of the base 202, the cathode 204, and the anode 210.

Thus, the lid 214 is (e.g., anodically) bonded to the anode 210 and to the cathode 204 to form the outlet 216A between the cathode 204 and the lid 214 and the outlet 216B between the anode 210 and the lid 214. The structure of the bonding of the lid 214 to the anode 210 and the cathode 204 is shown in more detail in subsequent Figures.

In the example of FIG. 3, the etching involves forming the portion 218 of the cathode 204 and the portion 218 of the anode 210. As such, the portion 220 (e.g., a conductive portion) of the cathode 204 is deposited in contact with the portion 218 of the cathode 204 and the portion 220 (e.g., a conductive portion) of the anode 210 is deposited in contact with the portion 218 of the anode 210. Additionally, the hydrophilic material is deposited on the surface of the base 202 between the cathode 204 and the anode 210. Alternatively, the surface of the base 202 between the cathode 204 and the anode 210 is intrinsically hydrophilic.

Once the hydrogen generator 200 has been fabricated, the electrolytic solution source 12 can be used to flow the electrolytic solution 208 comprising water, sodium chloride, potassium chloride, calcium chloride, and/or sodium hydroxide through the cavity 213. Additionally, the power supply 222A applies an electric field between the anode 210 and the cathode 204 while the anode 210 and the cathode 204 are immersed in the electrolytic solution 208. In this way, the hydrogen 206 is generated at the cathode 204 such that the hydrogen 206 exits the cavity 213 via the outlet 216A and the oxygen 212 is generated at the anode 210 such that the oxygen 212 exits the cavity 213 via the outlet 216B.

In some examples, the computing device 100 and/or the control system 14 can be used to selectively enable a specified quantity of the hydrogen generators 200 to provide a desired level of hydrogen generation.

In some examples, the computing device 100 determines that a demand for the hydrogen 206 has increased from a previous level of demand and then responsively applies an electric field via the power supply 222A of an additional hydrogen generator 200 between the anode 210 of the additional hydrogen generator 200 and the cathode 204 of the additional hydrogen generator 200. The anode 210 and the cathode 204 of the additional hydrogen generator 200 are immersed in the electrolytic solution 208 as the power supply 222A of the additional hydrogen generator 200 generates the electric field. Thus, the additional hydrogen 206 is generated at the cathode 204 of the additional hydrogen generator 200 such that the additional hydrogen 206 exits the additional cavity 213 via the outlet 216A of the additional hydrogen generator 200. Also, additional oxygen 212 is generated at the anode 210 of the additional hydrogen generator 200 such that the additional oxygen 212 exits the additional cavity 213 via the outlet 216B of the additional hydrogen generator 200.

Thereafter, the computing device 100 determines that the demand for the hydrogen 206 has decreased and responsively disables the electric field generated by the power supply 222A of the additional hydrogen generator 200, thereby ceasing production of the additional hydrogen 206.

Figure 4:
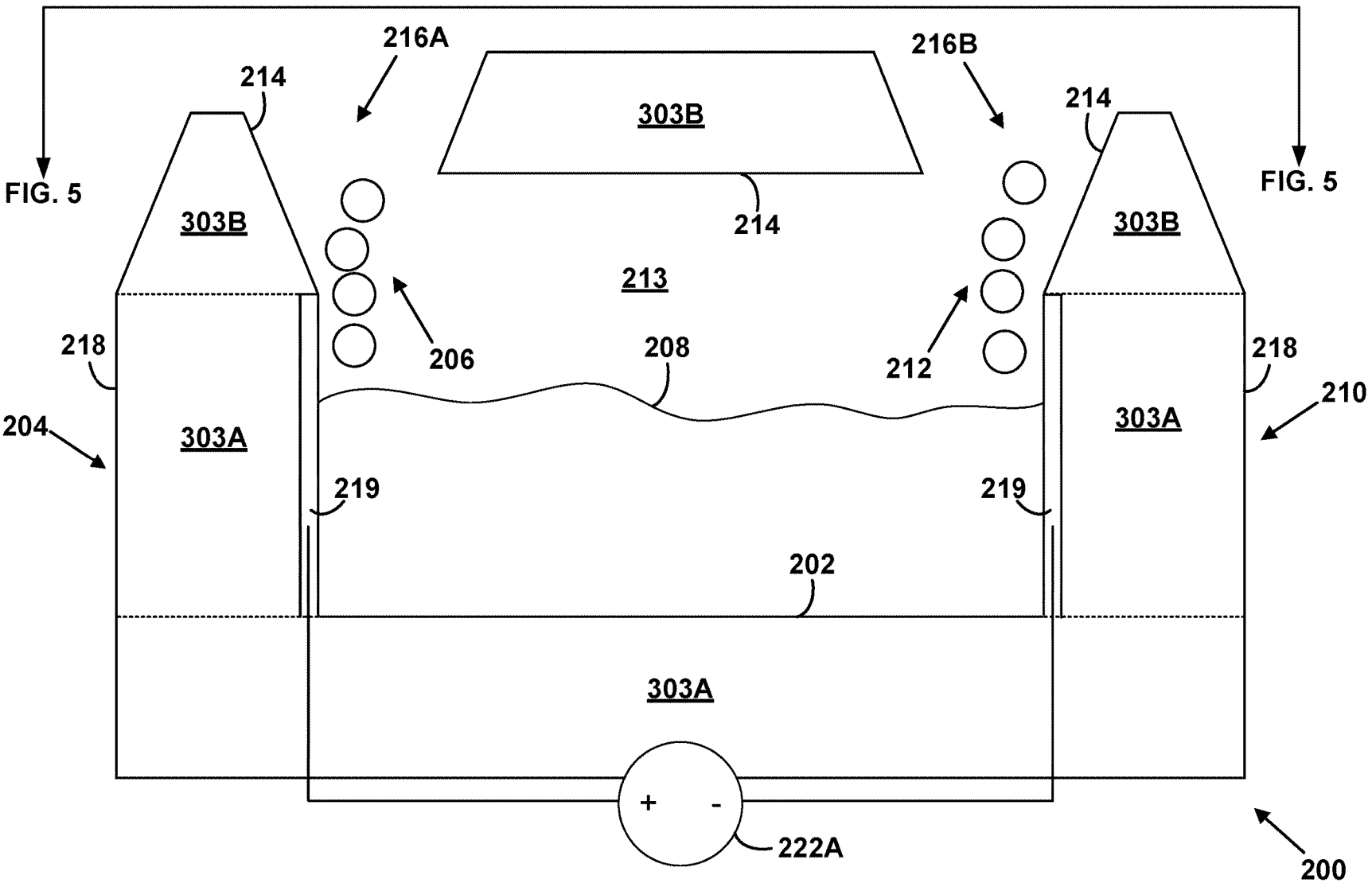
FIG. 4 is a schematic diagram of a hydrogen generator, according to an example.

FIG. 4 is a schematic diagram of a hydrogen generator 200. The hydrogen generator 200 of FIG. 4 includes any or all of the structural features of the hydrogen generator 200 described above with reference to FIG. 3, unless context clearly dictates otherwise. Additionally, the hydrogen generator 200 of FIG. 4 can be used to perform any of the functionality described herein with reference to the hydrogen generator 200 shown in FIG. 3.

In FIG. 4, the cathode 204 includes a doped region 219. That is, impurities such as boron, aluminum, gallium, and/or indium are introduced into the doped region 219 of the cathode 204 to increase the conductivity of the cathode 204. Similarly, the anode 210 includes a doped region 219 that includes dopants such as phosphorus, arsenic, antimony, bismuth, and/or lithium.

Once the hydrogen generator 200 has been fabricated, the electrolytic solution source 12 can be used to flow the electrolytic solution 208 comprising water, sodium chloride, potassium chloride, calcium chloride, and/or sodium hydroxide through the cavity 213. Additionally, the power supply 222A applies an electric field between the doped region 219 of the anode 210 and the doped region 219 of the cathode 204 while the anode 210 and the cathode 204 are immersed in the electrolytic solution 208. In this way, the hydrogen 206 is generated at the cathode 204 such that the hydrogen 206 exits the cavity 213 via the outlet 216A and the oxygen 212 is generated at the anode 210 such that the oxygen 212 exits the cavity 213 via the outlet 216B.

Figure 5:
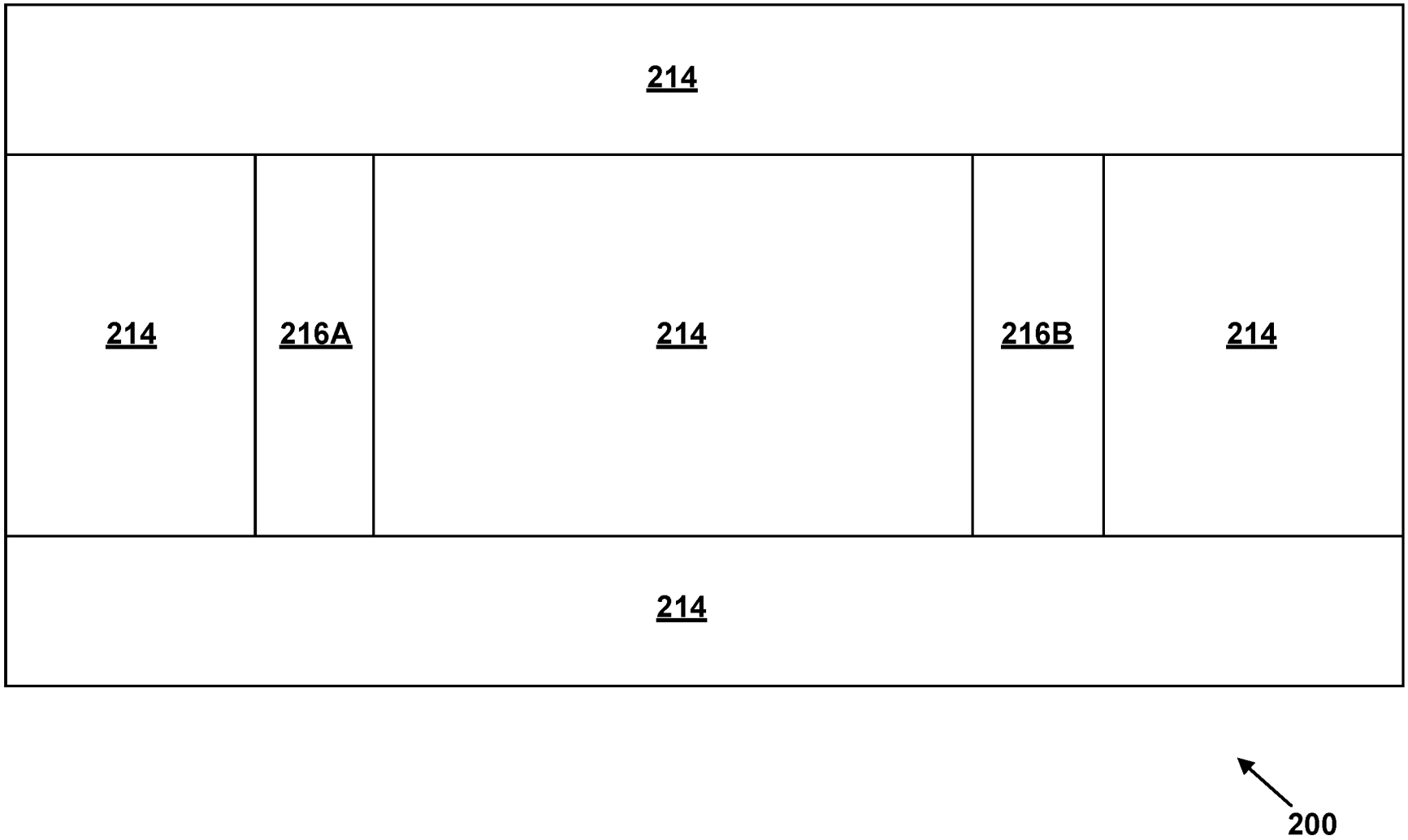
FIG. 5 is an overhead view of a hydrogen generator, according to an example.

FIG. 5 is an overhead view of the hydrogen generator 200 shown in FIG. 3 and the hydrogen generator 200 shown in FIG. 4.

Figure 6:
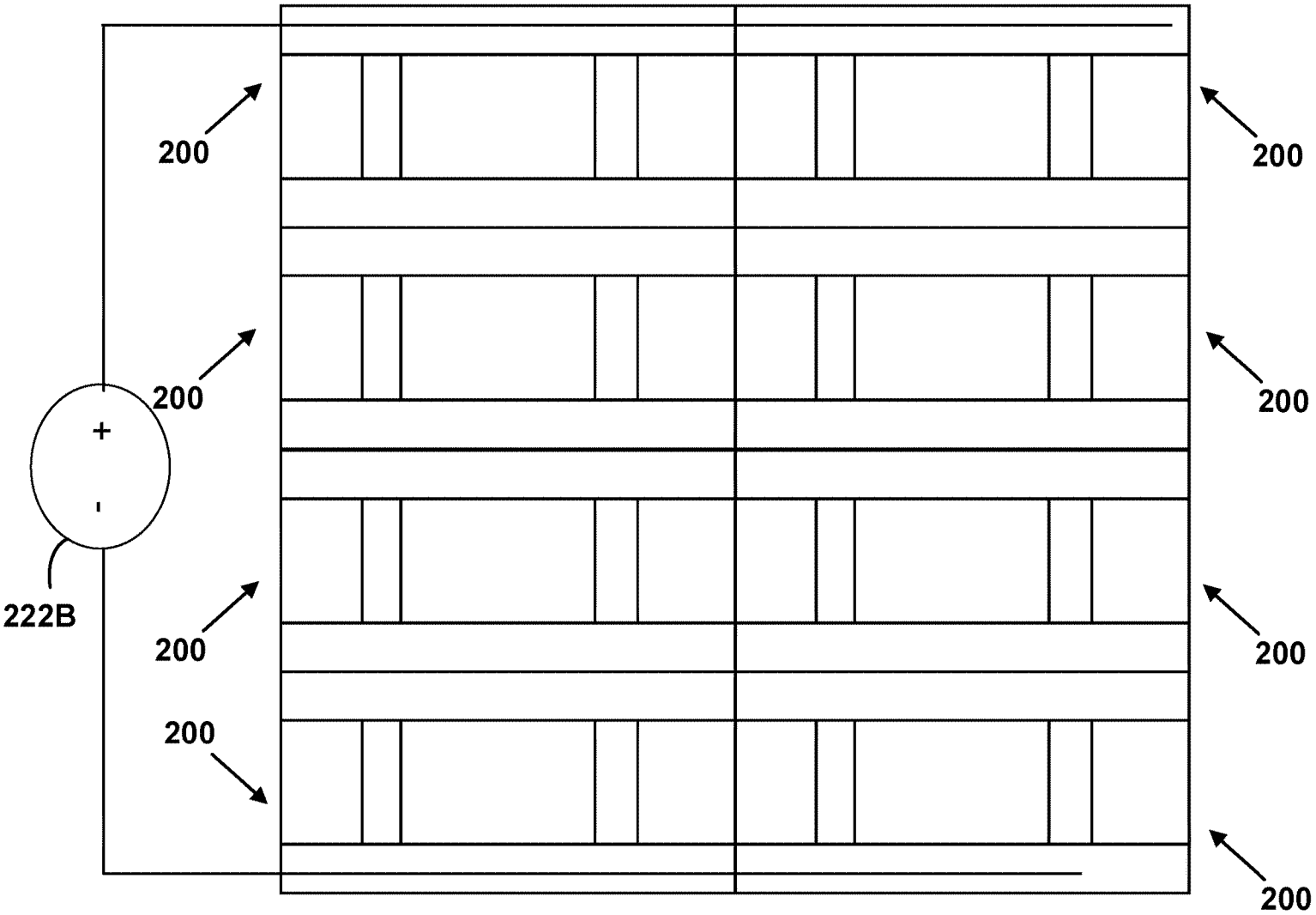
FIG. 6 is an overhead view of an array of hydrogen generators, according to an example.
Figure 7:
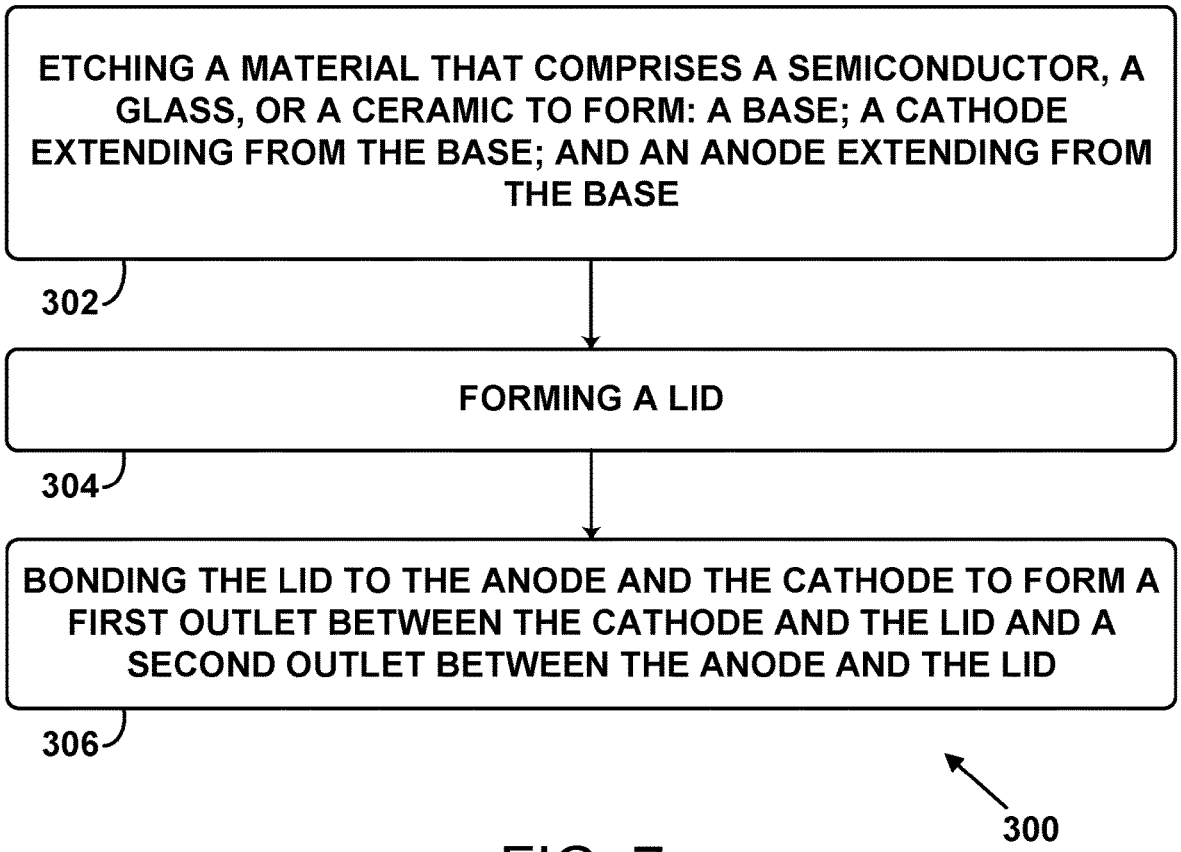
FIG. 7 is a block diagram of a method, according to an example.
Figure 8:
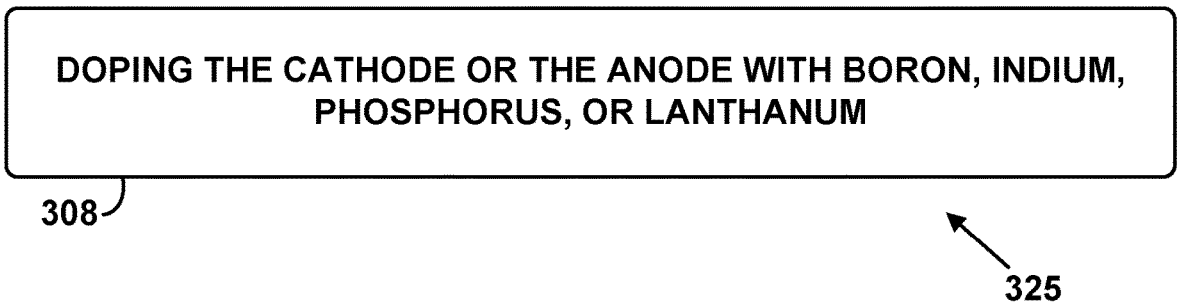
FIG. 8 is a block diagram of a method, according to an example.
Figure 9:
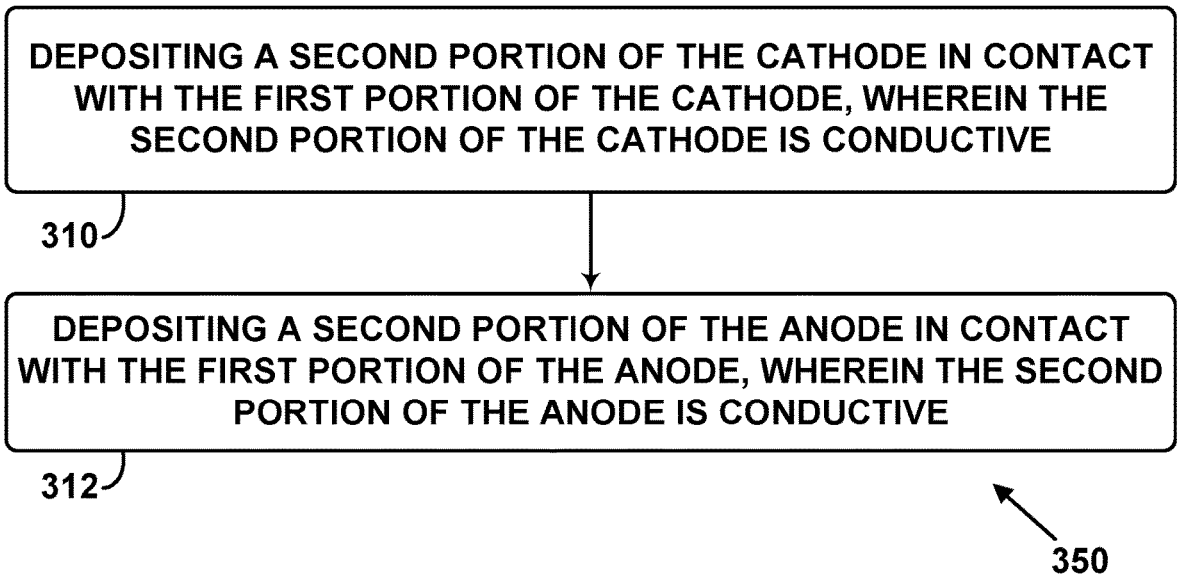
FIG. 9 is a block diagram of a method, according to an example.
Figure 10:
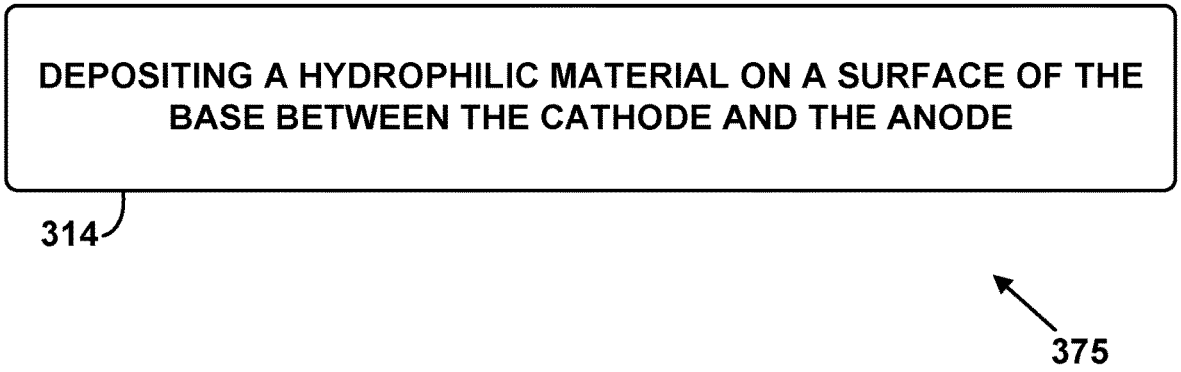
FIG. 10 is a block diagram of a method, according to an example.
Figure 11:
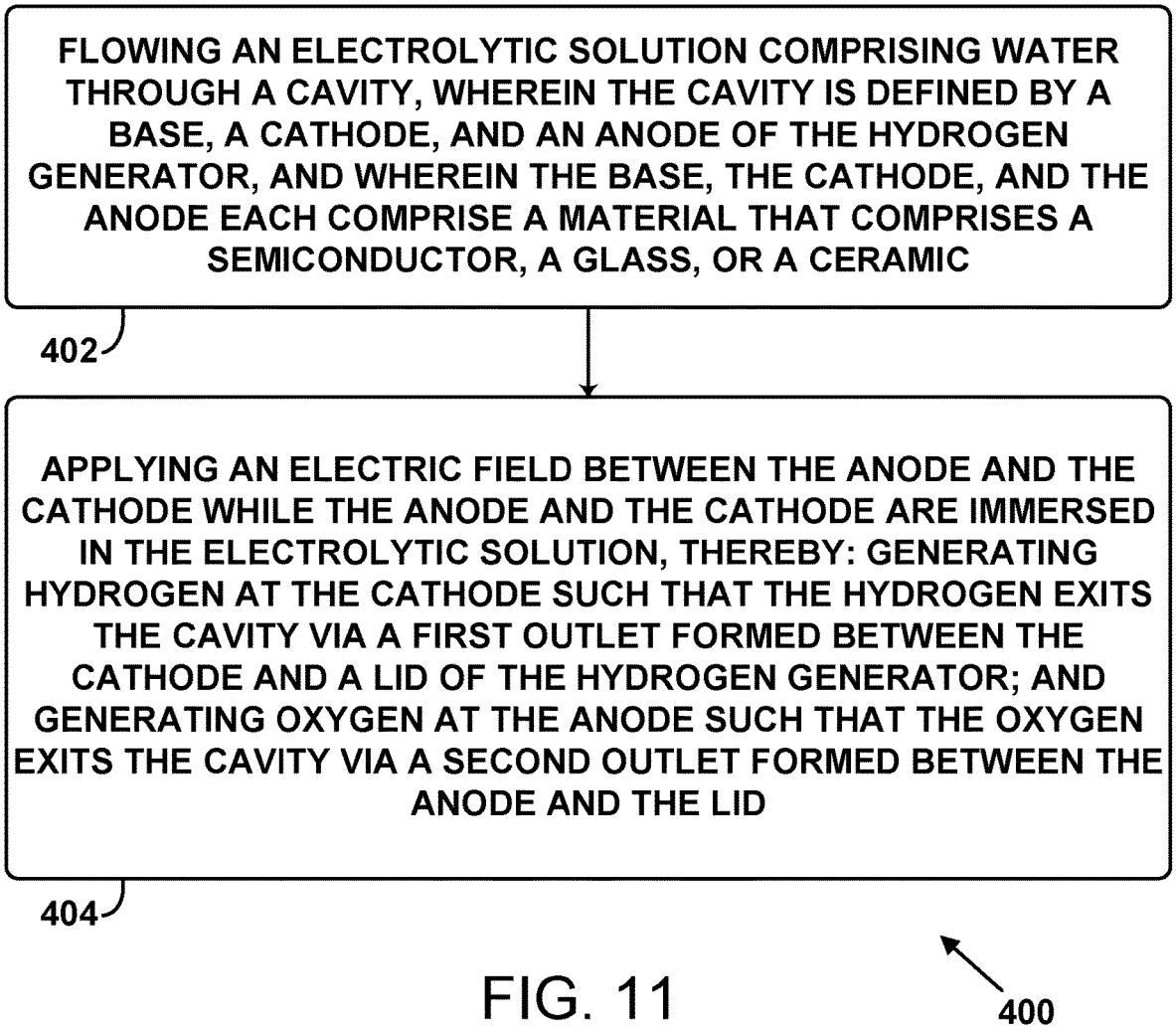
FIG. 11 is a block diagram of a method, according to an example.
Figure 12:
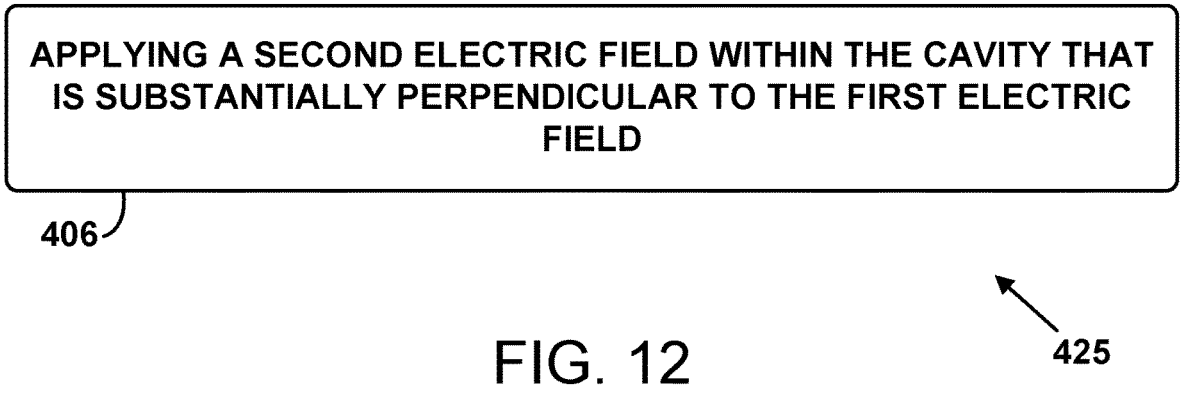
FIG. 12 is a block diagram of a method, according to an example.
Figure 13:
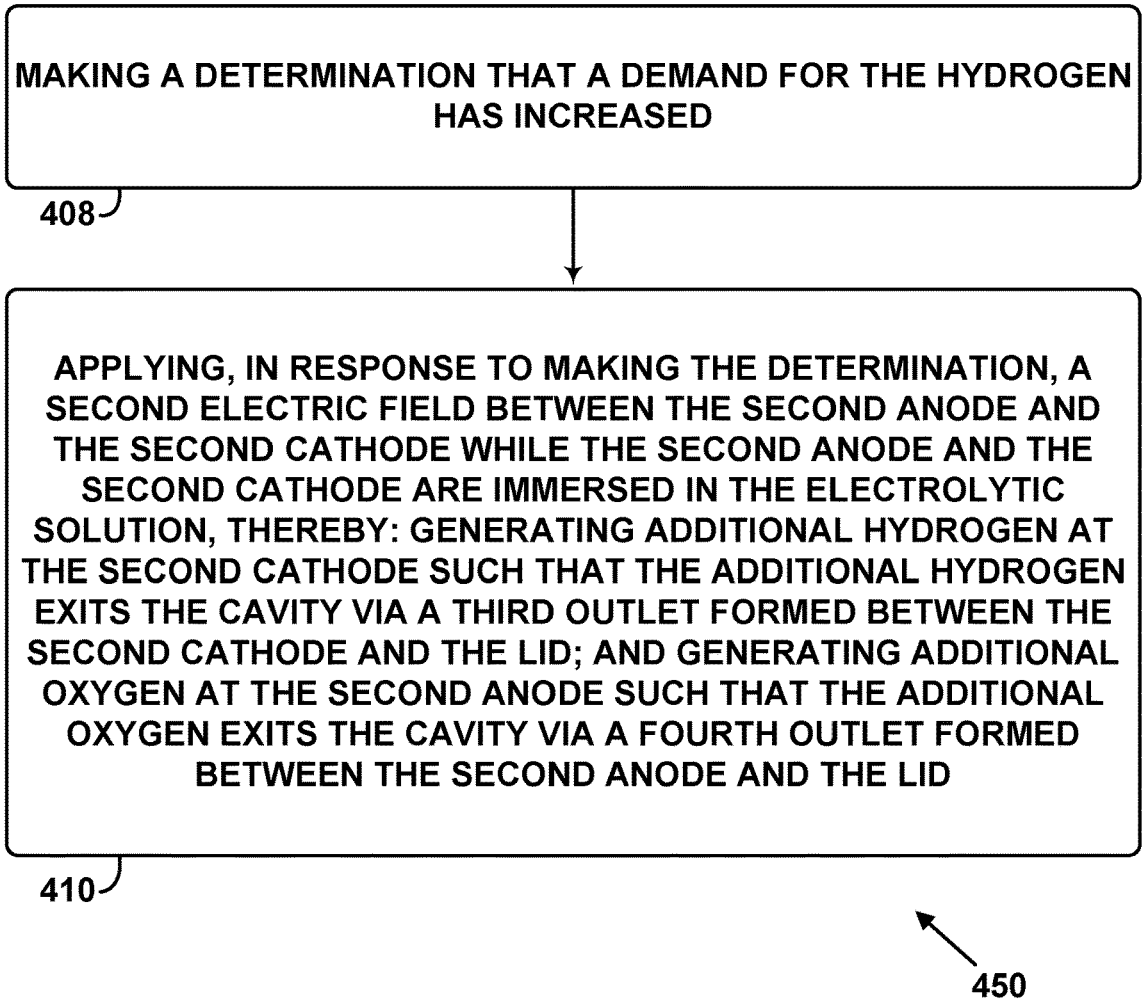
FIG. 13 is a block diagram of a method, according to an example.
Figure 14:
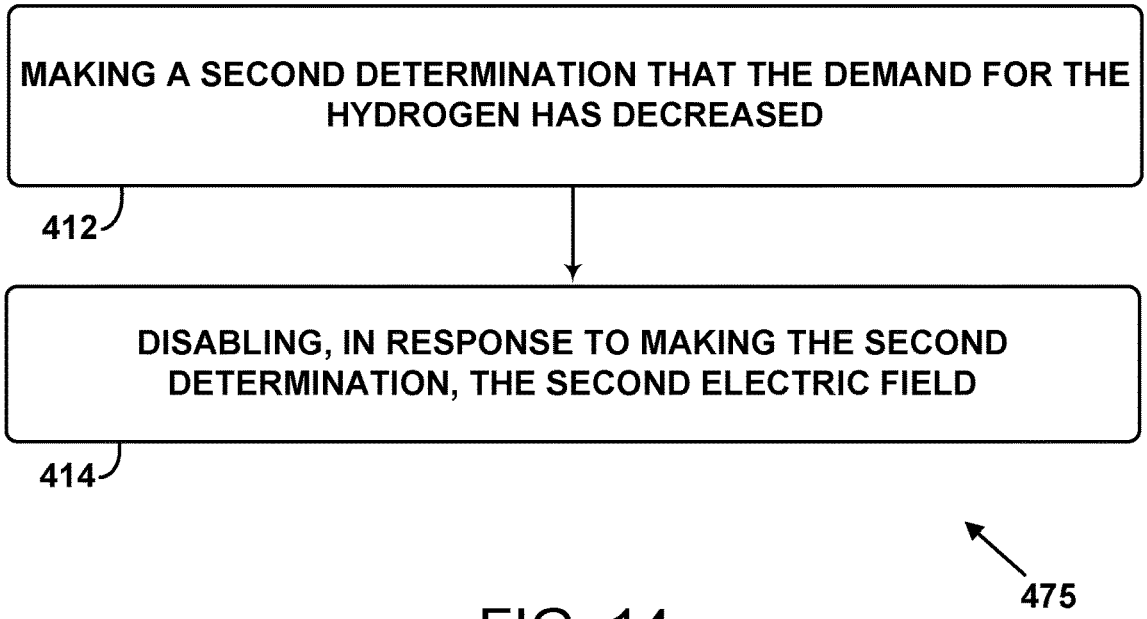
FIG. 14 is a block diagram of a method, according to an example.

FIG. 6 is an overhead view of an array of hydrogen generators 200. As noted above, the computing device 100 and/or the control system 14 can be used to selectively enable a specified quantity of the hydrogen generators 200 to provide a desired level of hydrogen production.

In some examples, a power supply 222B generates an electric field within the cavities 213 of the hydrogen generators 200 that is substantially perpendicular to the electric fields generated by the power supplies 222A shown in FIG. 3 and FIG. 4. The electric field generated by the power supply 222B can help facilitate transport of the electrolytic solution 208 via ion transport.

FIGS. 7-14 are block diagrams of methods 300, 325, 350, 375, 400, 425, 450, and 475 of manufacturing or operating the hydrogen generator 200. As shown in FIGS. 7-14, the methods 300, 325, 350, 375, 400, 425, 450, and 475 include one or more operations, functions, or actions as illustrated by blocks 302, 304, 306, 308, 310, 312, 314, 402, 404, 406, 408, 410, 412, and 414. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

At block 302, the method 300 includes etching the material 303A that comprises a semiconductor, a glass, or a ceramic to form the base 202, the cathode 204 extending from the base 202, and the anode 210 extending from the base 202. Functionality related to block 302 is described above with reference to FIGS. 3 and 4.

At block 304, the method 300 includes forming the lid 214. Functionality related to block 304 is described above with reference to FIGS. 3 and 4.

At block 306, the method 300 includes bonding the lid 214 to the anode 210 and the cathode 204 to form the outlet 216A between the cathode 204 and the lid 214 and the outlet 216B between the anode 210 and the lid 214. Functionality related to block 306 is described above with reference to FIGS. 3 and 4.

At block 308, the method 325 includes doping the cathode 204 or the anode 210 with boron, indium, phosphorus, or lanthanum. Functionality related to block 308 is described above with reference to FIG. 4.

At block 310, the method 350 includes depositing the portion 220 of the cathode 204 in contact with the portion 218 of the cathode 204. The portion 220 of the cathode 204 is conductive. Functionality related to block 310 is described above with reference to FIG. 3.

At block 312, the method 350 includes depositing the portion 220 of the anode 210 in contact with the portion 218 of the anode 210. The portion 220 of the anode 210 is conductive. Functionality related to block 312 is described above with reference to FIG. 3.

At block 314, the method 375 includes depositing a hydrophilic material on a surface of the base 202 between the cathode 204 and the anode 210. Functionality related to block 314 is described above with reference to FIGS. 3 and 4.

At block 402, the method 400 includes flowing the electrolytic solution 208 comprising water through the cavity 213. The cavity 213 is defined by the base 202, the cathode 204, and the anode 210. The base 202, the cathode 204, and the anode 210 each comprise a material that comprises a semiconductor, a glass, or a ceramic. Functionality related to block 402 is described above with reference to FIGS. 3-6.

At block 404, the method 400 includes applying an electric field between the anode 210 and the cathode 204 while the anode 210 and the cathode 204 are immersed in the electrolytic solution 208, thereby: generating the hydrogen 206 at the cathode 204 such that the hydrogen 206 exits the cavity 213 via the outlet 216A formed between the cathode 204 and the lid 214 of the hydrogen generator 200 and generating oxygen 212 at the anode 210 such that the oxygen 212 exits the cavity 213 via the outlet 216B formed between the anode 210 and the lid 214. Functionality related to block 404 is described above with reference to FIGS. 3-6.

At block 406, the method 425 includes applying a second electric field via the power supply 222B within the cavity 213 that is substantially perpendicular to the first electric field applied by the power supply 222A. Functionality related to block 406 is described above with reference to FIG. 6.

At block 408, the method 450 includes making a determination that a demand for the hydrogen 206 has increased. Functionality related to block 408 is described above with reference to FIG. 3.

At block 410, the method 450 includes applying, in response to making the determination, a second electric field between a second anode 210 and a second cathode 204 while the second anode 210 and the second cathode 204 are immersed in the electrolytic solution 208, thereby: generating additional hydrogen 206 at the second cathode 204 such that the additional hydrogen 206 exits the cavity 213 via the outlet 216A formed between the second cathode 204 and the lid 214 and generating additional oxygen 212 at the second anode 210 such that the additional oxygen 212 exits the cavity 213 via the outlet 216B formed between the second anode 210 and the lid 214. Functionality related to block 410 is described above with reference to FIG. 3.

At block 412, the method 475 includes making a second determination that the demand for the hydrogen 206 has decreased. Functionality related to block 412 is described above with reference to FIG. 3.

At block 414, the method 475 includes disabling, in response to making the second determination, the electric field applied by the additional power supply 222A between the second anode 210 and the second cathode 204. Functionality related to block 414 is described above with reference to FIG. 3.

The description of the different advantageous arrangements has been presented for purposes of illustration and description, and is not intended to be exhaustive or limited to the examples in the form disclosed. Many modifications and variations will be apparent to those of ordinary skill in the art. Further, different advantageous examples may describe different advantages as compared to other advantageous examples. The example or examples selected are chosen and described in order to explain the principles of the examples, the practical application, and to enable others of ordinary skill in the art to understand the disclosure for various examples with various modifications as are suited to the particular use contemplated.

What is claimed is:

1. A hydrogen generator comprising:

a base comprising a first material that comprises a semiconductor, a glass, or a ceramic;

a cathode extending from the base, wherein the cathode comprises the first material and is configured to facilitate generation of hydrogen in the presence of an electrolytic solution that comprises water;

an anode extending from the base, wherein the anode comprises the first material and is configured to facilitate generation of oxygen in the presence of the electrolytic solution, wherein the base, the cathode, and the anode define a cavity; and a lid comprising a second material that comprises a semiconductor, a glass, or a ceramic, the lid forming a first outlet between the cathode and the lid and a second outlet between the anode and the lid, wherein the hydrogen is configured to exit the cavity via the first outlet and the oxygen is configured to exit the cavity via the second outlet.

2. The hydrogen generator of claim 1, wherein the first material or the second material is monocrystalline or polycrystalline.

3. The hydrogen generator of claim 1, wherein the first material or the second material is doped with boron, indium, phosphorus, or lanthanum.

4. The hydrogen generator of claim 1, wherein the cathode and the anode each comprise:

a first portion comprising the first material; and a second portion that is supported by the first portion, wherein the second portion comprises a conductive material.

5. The hydrogen generator of claim 4, wherein the conductive material comprises platinum, copper, a perovskite material, or lanthanum ferrite.

6. The hydrogen generator of claim 1, wherein the cathode and the anode are in contact with the base.

7. The hydrogen generator of claim 1, further comprising:

a first power supply configured to generate a first electric field within the cavity between the anode and the cathode; and a second power supply configured to generate a second electric field within the cavity that is substantially perpendicular to the first electric field.

8. The hydrogen generator of claim 1, wherein the base, the cathode, and the anode form a singular structure.

9. The hydrogen generator of claim 1, wherein the base further comprises a hydrophilic material on a surface of the base between the cathode and the anode.

10. A method of manufacturing a hydrogen generator, the method comprising:

etching a first material that comprises a semiconductor, a glass, or a ceramic to form:

a base;

a cathode extending from the base; and an anode extending from the base;

forming a lid comprising a second material that comprises a semiconductor, a glass, or a ceramic; and bonding the lid to the anode and the cathode to form a cavity, where in the lid forms a first outlet between the cathode and the lid for hydrogen to exit the cavity and a second outlet between the anode and the lid for oxygen to exit the cavity.

11. The method of claim 10, wherein the first material is monocrystalline or polycrystalline.

12. The method of claim 10, further comprising doping the cathode or the anode with boron, indium, phosphorus, or lanthanum.

13. The method of claim 10, wherein etching the first material to form the cathode and the anode comprises etching the first material to form a first portion of the cathode and a first portion of the anode, the method further comprising:

depositing a second portion of the cathode in contact with the first portion of the cathode, wherein the second portion of the cathode is conductive; and depositing a second portion of the anode in contact with the first portion of the anode, wherein the second portion of the anode is conductive.

14. The method of claim 13, wherein the second portion of the cathode or the second portion of the anode comprises platinum, copper, a perovskite material, or lanthanum ferrite.

15. The method of claim 10, further comprising depositing a hydrophilic material on a surface of the base between the cathode and the anode.

16. A method of operating a hydrogen generator, the method comprising:

flowing an electrolytic solution comprising water through a cavity, wherein the cavity is defined by a base, a cathode extending from the base, and an anode extending from the base of the hydrogen generator, and wherein the base, the cathode, and the anode each comprise a first material that comprises a semiconductor, a glass, or a ceramic; and applying an electric field between the anode and the cathode while the anode and the cathode are immersed in the electrolytic solution, thereby:

generating hydrogen at the cathode such that the hydrogen exits the cavity via a first outlet by a lid of the hydrogen generator between the cathode and the lid, the lid comprising a second material that comprises a semiconductor, a glass, or a ceramic; and generating oxygen at the anode such that the oxygen exits the cavity via a second outlet formed by the lid between the anode and the lid.

17. The method of claim 16, wherein the electric field is a first electric field, the method further comprising: applying a second electric field within the cavity that is substantially perpendicular to the first electric field.

18. The method of claim 16, wherein flowing the electrolytic solution comprises flowing the electrolytic solution that comprises sodium chloride, potassium chloride, calcium chloride, or sodium hydroxide.

19. The method of claim 16, wherein the hydrogen generator is a first hydrogen generator and the cavity is further defined by a second base, a second cathode, and a second anode of a second hydrogen generator, the method further comprising:

making a determination that a demand for the hydrogen has increased; and applying, in response to making the determination, a second electric field between the second anode and the second cathode while the second anode and the second cathode are immersed in the electrolytic solution, thereby:

generating additional hydrogen at the second cathode such that the additional hydrogen exits the cavity via a third outlet formed between the second cathode and the lid; and generating additional oxygen at the second anode such that the additional oxygen exits the cavity via a fourth outlet formed between the second anode and the lid.

20. The method of claim 19, further comprising:

making a second determination that the demand for the hydrogen has decreased; and disabling, in response to making the second determination, the second electric field.

* * * * *